United States Patent [19]

Fischer

[11] Patent Number: 4,619,449

[45] Date of Patent: Oct. 28, 1986

[54] FOLDING APPARATUS FOR FOLDING SUPERPOSED MULTIPLE WEBS

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 817,156

[22] Filed: Jan. 7, 1986

Related U.S. Application Data

[63] Continuation of Ser. No. 677,171, Dec. 3, 1984, abandoned.

[30] Foreign Application Priority Data

Dec. 31, 1983 [DE] Fed. Rep. of Germany ..... 3347715

[51] Int. Cl.[4] ..... B41F 13/58

[52] U.S. Cl. ..... 270/5; 493/446

[58] Field of Search ..... 270/5; 226/76–77, 226/82, 87; 400/616.3; 493/446, 454, 459

[56] References Cited

U.S. PATENT DOCUMENTS

| | | | |
|---|---|---|---|
| 2,107,462 | 2/1938 | Wood | 270/5 |
| 2,185,049 | 12/1939 | Beidler | 226/82 |
| 2,500,196 | 3/1950 | Metzner | 226/87 |
| 3,347,433 | 10/1967 | Bernard | 226/87 X |
| 3,969,828 | 7/1976 | Roberts | 226/87 X |
| 4,274,184 | 6/1981 | Nordtvedt | 226/77 X |

FOREIGN PATENT DOCUMENTS

| | | | |
|---|---|---|---|
| 470857 | 8/1937 | United Kingdom | 270/5 |
| 769550 | 3/1957 | United Kingdom | 493/446 |

*Primary Examiner*—E. H. Eickholt

*Attorney, Agent, or Firm*—Frishauf, Holtz, Goodman & Woodward

[57] ABSTRACT

To prevent buckling of a lowermost one, or a lower group of superposed webs being fed, in superposed relation to a common folding triangle or folding former (1), a driven supply roller (2) is provided which has its circumference formed with projecting pins (6) or the like, long enough to penetrate through the entire stack of the superposed web (8) as it runs over the supply roller, thereby feeding all the webs at the same speed to the folding former. Preferably, a hold-down roller (9) is provided, formed with a circumferential groove (10) aligned with the pins (6) so that the pins can penetrate through the webs and fit into the groove (10).

14 Claims, 3 Drawing Figures

FOLDING APPARATUS FOR FOLDING SUPERPOSED MULTIPLE WEBS

This application is a continuation of application Ser. No. 677,171, filed Dec. 3, 1984 and now abandoned. Reference to related patent: German Published Application DE-AS No. 1 141 650.

The present invention relates to a longitudinal folding apparatus, and more particularly to a folding apparatus to receive a plurality of superposed webs received, for example, from a rotary printing machine.

BACKGROUND

Rotary printing machines may deliver a plurality of webs which are to be guided over a folding triangle. Upon folding, it has been found that improper folding and pinching may occur at the inner webs, as they are being folded, thus resulting in improper folding of all the webs which are superposed. Under some conditions, the paper even may tear.

It has previously been proposed to avoid the aforementioned disadvantages—see, for example, German Published Application DE-AS No. 1 141 650—to provide one or more pairs of supply rollers positioned close to the folding triangle or folding funnel, and which contact each other, with the web interposed, in the plane of the folding triangle. Usually, the rollers which are located below the folding triangle or folding funnel or folding former are located beneath the triangle or former, for example in recesses, notches or grooves formed therein. These rollers are driven, preferably with the speed of the uppermost one of the webs. The arrangement is intended to match the speed of the lowermost web to that of the uppermost web. Speed differences between the remaining webs, for example if a plurality of webs greater than two is to be superimposed, cannot, however, be entirely eliminated, and improper folds, pleats, pinched zones, or tears of the intervening webs cannot be avoided by this arrangement.

THE INVENTION

It is an object to improve folding of a plurality of superposed webs, and particularly of such a plurality in which the thickness of the folded webs will be such that a difference in speed between the lower and uppermost webs may occur; the arrangement is to prevent improperly formed folds or pleats, and tearing of the webs.

Briefly, supply rollers are provided adjacent the inlet to the folding triangle or folding former; in accordance with the invention, a plurality of engagement projections extend radially outwardly from the circumference of the supply roller. These engagement projections are located, staggered about the circumference of the supply roller, in a zone which does not carry printed subject matter. The length of these engagement projections is sufficient for penetration through the superposed webs running over the supply roller, to thereby provide for positive feed of all the webs of the superposed plurality at the same speed, so that the webs are fed without buckling, creasing or tearing over the folding triangle or folding former.

DRAWINGS

DETAILED DESCRIPTION

Figure 1:
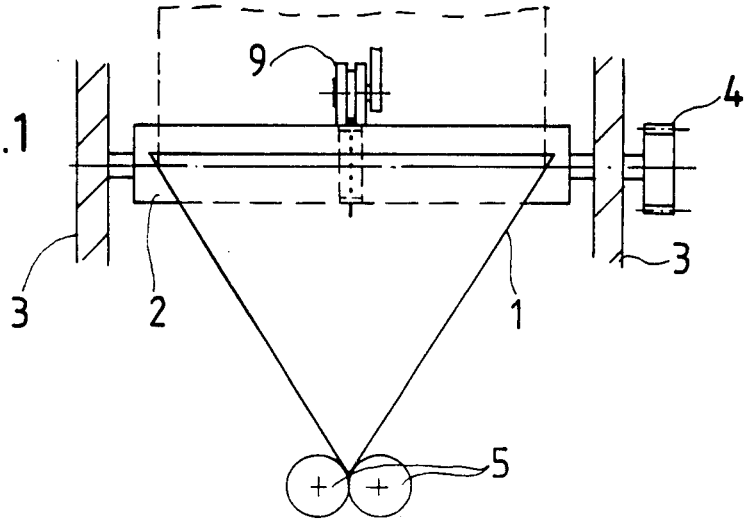
FIG. 1 is a schematic front view of the folding arrangement.

A folding former 1, of standard construction, receives a plurality of webs 8 (FIG. 2) over an inlet roller 2. The frame for the structure, shown only schematically by frame walls 3, is provided with suitable bearings for a gear 4, which gear 4 is driven by other gears—not shown—and coupled, for example, to the machine drive of a printing machine on which the webs 8 have been printed. Two pull-off rollers 5 are provided at the outlet of the folding former or folding triangle 1. Up to this point, the arrangement is conventional.

In accordance with a feature of the invention, the supply roller 2 is formed with a plurality of projections 6. The projections 6 form engagement pins and are located in a zone of a strip of unprinted material on the webs 8. A plurality of circumferentially placed rows of engagement projections 6 may be provided if the webs 8 have a plurality of unprinted zones or strips thereon. The engagement projections 6 are formed as pointed needles, but need not be; they may also be formed in conical form, frusto-conical form, or pyramidal bodies. Knife-like elements with short blades may also be used. Preferably, the engagement projections 6 are secured to a tape or strip or the like fitted into a groove 7 of the supply roller 2, and adhesively secured therein. Such a strip can be easily made externally of the roller, and then assembled to the roller 2. The roller 2, then, may be termed a "prickly roller".

Figure 2:
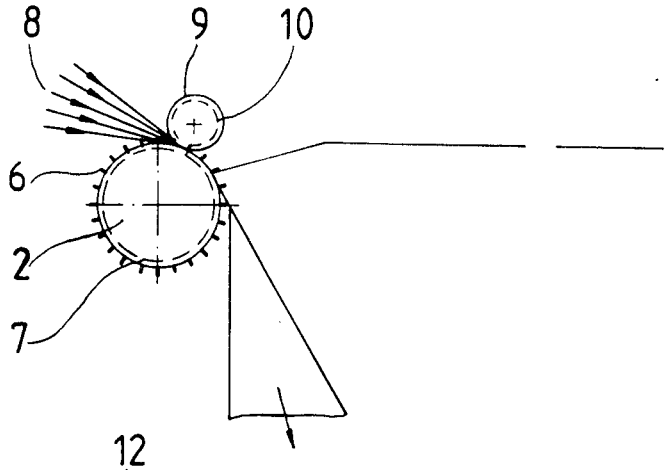
FIG. 2 is an end view of the folding arrangement in which the side walls have been omitted to show the feeding of a plurality of webs, and the roller with the projections.

Operation, with reference to FIG. 2: A plurality of webs 8, being supplied in superposed relation to the roller, are engaged by the engagement projections 6, which will penetrate through the plurality of webs. The length of the projections 6 is such that, with all the webs superposed, the projections will reliably penetrate through the entire set or stack of webs. This insures that all the webs will be supplied with the same speed to the folding triangle or folding former 1. Buckling and backing-up of the innermost web, or the inner group of webs which may form a buckling loop in advance of the supply roller 2, and subsequently pinched folds are thereby prevented.

The projections 6 should, preferably, be as short as possible, just long enough to penetrate the entire stack of superposed webs 8. To insure that the outermost web 8 is still penetrated by the roller, an additional hold-down engagement roller 9 is preferably provided which presses all the superposed webs 8 against the supply roller 2. The engagement roller 9 is formed with a groove or recess 10, extending circumferentially about the roller 9, to receive the projections 6, if the projections 6 are longer than the webs being supplied thereto—for example if a lesser number of webs 8 is being supplied than the maximum which the folder can accept. The roller 9 need not be driven, but may ride and rotate loosely by frictional engagement, carried along by the uppermost one of the webs 8.

Figure 3:
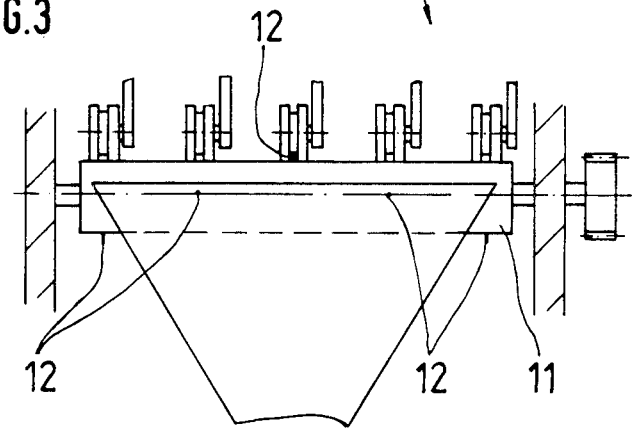
FIG. 3 illustrates a modification for webs having a plurality of non-printed zones.

FIG. 3 illustrates an embodiment in which a supply roller 11 is provided to guide webs which, besides a central folding strip, which is not printed, additionally has three further unprinted longitudinal strips. Engagement projections 12 are located circumferentially about the roller 11, positioned not only circumferentially staggered, but also axially staggered or offset. The looping of the webs 8 about the supply roller 12 then should be so selected that the webs 8 are guided by at least one roller 9, preferably more than one roller 9, symmetrically with respect to the central strip of projections. Thus, rather than having a single circumferentially positioned row of engagement projections, a plurality of axially spaced and/or circumferentially positioned engagement projections are used, located to engage all the superposed webs in zones where no printed subject matter appears. The arrangement of FIG. 3, thus, permits locating engagement projections even if no continuous strips of unprinted subject matter is delivered from the printing machines.

Various changes and modifications may be made, and features described in connection with one of the embodiments may be used with the other, within the scope of the inventive concept.

I claim:

1. For combination with a rotary printing machine having a machine drive and supplying a plurality of running, superposed webs (8), a folding apparatus having a folding triangle or folding former (1);

a pull-off means (5) located downstream of an end zone of the folding triangle or folding member (1); and the combination of a supply roller (2), driven at machine speed by the machine drive of said printing machine, positioned adjacent, upstream—in the direction of run of the webs—of a beginning zone of the folding triangle or folding former, the plurality of webs (8) being guided to run over said supply roller (2)

with means for preventing unequal feeding rates among superposed webs subjected to unequal tractive force from said driven roller (2), and consequent buckling, creasing, and tearing of said webs, said means comprising a plurality of engagement projections (6) extending radially outwardly from the circumference of the supply roller (2) located staggered about the circumference of the supply roller and having lengths sufficient for perforation through the superposed webs running over the supply roller (2).

2. Folding apparatus according to claim 1, wherein the engagement projections (6) are needle-shaped.

3. Folding apparatus according to claim 1, wherein the engagement projections are located in a circumferential row extending about the circumference of the supply roller (2).

4. Folding apparatus according to claim 3, further including a band or tape-like flexible carrier to which the engagement projections (6) are secured;

and a groove (7) formed in the supply roller (2) in which said flexible tape or band is secured, with the engagement projections extending radially outwardly.

5. Folding apparatus according to claim 3, wherein the circumferential row of engagement projections (6) is located axially centrally on the supply roller (2).

6. Folding apparatus according to claim 5, wherein the engagement projections (6) are needle-shaped.

7. Folding apparatus according to claim 1, further including a hold-down roller (9) having a circumferential groove (10) located against the uppermost one of the plurality of webs (8) to hold down said plurality of webs against the supply roller (2), the circumferential groove (10) being positioned in alignment with the engagement projections and to permit entry of the engagement projections into said circumferential groove.

8. Folding apparatus according to claim 1, wherein (FIG. 3) the engagement projections are located axially and circumferentially staggered about the circumference of the supply roller (2).

9. Folding apparatus according to claim 8, further including a hold-down roller (9) having a circumferential groove (10) located against the uppermost one of the plurality of webs (8) to hold down said plurality of webs against the supply roller (2), the circumferential groove (10) being positioned in alignment with the engagement projections and to permit entry of the engagement projections into said circumferential groove.

10. Folding apparatus according to claim 3, wherein the row of engagement projections is located in alignment with the folding crease to be formed by the folding triangle or former (1).

11. Folding apparatus according to claim 3, wherein the row of engagement projections is located to match a strip of unprinted subject matter on the webs (8).

12. Folding apparatus according to claim 1, wherein the engagement projections (6) are located on the supply roller (2) to fit into zones of unprinted subject matter on said webs (8) running over the supply roller (2).

13. Folding apparatus according to claim 11, further including a hold-down roller (9) having a circumferential groove (10) located against the uppermost one of the plurality of webs (8) to hold down said plurality of webs against the supply roller (2), the circumferential groove (10) being positioned in alignment with the engagement projections and to permit entry of the engagement projections into said circumferential groove.

14. Folding apparatus according to claim 12, further including a hold-down roller (9) having a circumferential groove (10) located against the uppermost one of the plurality of webs (8) to hold down said plurality of webs against the supply roller (2), the circumferential groove (10) being positioned in alignment with the engagement projections and to permit entry of the engagement projections into said circumferential groove.

* * * * *